US011668049B2

(12) United States Patent
Ueda et al.

(10) Patent No.: US 11,668,049 B2
(45) Date of Patent: Jun. 6, 2023

(54) INDUSTRIAL TWO-LAYER FABRIC

(71) Applicant: NIPPON FILCON CO., LTD., Tokyo (JP)

(72) Inventors: Ikuo Ueda, Shizuoka (JP); Kunio Nomura, Shizuoka (JP); Toru Egawa, Shizuoka (JP); Hideyuki Yanai, Shizuoka (JP)

(73) Assignee: NIPPON FILCON CO., LTD., Tokyo (JP)

( * ) Notice: Subject to any disclaimer, the term of this patent is extended or adjusted under 35 U.S.C. 154(b) by 225 days.

(21) Appl. No.: 17/044,116

(22) PCT Filed: Mar. 13, 2019

(86) PCT No.: PCT/JP2019/010206
§ 371 (c)(1),
(2) Date: Sep. 30, 2020

(87) PCT Pub. No.: WO2019/188278
PCT Pub. Date: Oct. 3, 2019

(65) Prior Publication Data

US 2021/0017709 A1 Jan. 21, 2021

(30) Foreign Application Priority Data

Mar. 30, 2018 (JP) ..... JP2018-067046

(51) Int. Cl.
*D21F 7/08* (2006.01)
*D21F 1/00* (2006.01)
*D03D 11/00* (2006.01)

(52) U.S. Cl.
CPC ..... *D21F 7/083* (2013.01); *D03D 11/00* (2013.01)

(58) Field of Classification Search
CPC .... D21F 1/0027; D21F 1/0036; D21F 1/0045; D21F 7/08; D21F 7/083; D21F 7/12; D03D 11/00; D03D 13/00; D03D 13/004
(Continued)

(56) References Cited

U.S. PATENT DOCUMENTS

2006/0048838 A1 3/2006 Takimoto
2006/0112999 A1 6/2006 Nagura et al.
(Continued)

FOREIGN PATENT DOCUMENTS

CN 105143549 A 12/2015
EP 1630270 A2 3/2006
(Continued)

OTHER PUBLICATIONS

Office Action issued in Japanese Application No. 2018-067046, dated Dec. 14, 2021.
(Continued)

*Primary Examiner* — Eric Hug
(74) *Attorney, Agent, or Firm* — Michael Best & Friedrich LLP

(57) ABSTRACT

The object of the present invention is to provide an industrial two-layered fabric including binding wefts which is capable of improving a high adhesivity of the fabric on the front and back surface sides and the supportability of the warps, without deteriorating the surface smoothness, the abrasion resistance on the back surface side, the extension resistance in the longitudinal direction and the hydration property, which have been conventionally desired.
The industrial two-layered fabric includes a first pair of warps consisting of a warp on the front surface side that weaves only a weft on the front surface side and a warp on the back surface side that weaves only the back surface side, and a second pair of warps consisting of a binding warp on
(Continued)

the front surface side and a binding warp on the back surface side which functions to bind the fabric on the front surface side and the fabric on the back surface side, the one of the binding warp constituting the second pair of the warps consecutively forms a plurality of knuckles on the fabric on the front surface side, while the other of the binding warps does not emerge on the front surface side at a portion where a plurality of knuckles are formed by the one of the binding warp, and the other binding warp consecutively forms a plurality of knuckles on the fabric on the front surface side, while the one binding warp does not emerge on the front surface side, whereby a complementary structure is formed, the diameter of the warp on the front surface side is set to be substantially the same as the diameter of the binding warp, and the diameter of the warp on the back surface side is set to be larger than the diameter of the binding warp on the front surface side.

7 Claims, 4 Drawing Sheets

(58) Field of Classification Search
USPC ..... 162/348, 900, 902, 903; 139/383 A, 139/425 A
See application file for complete search history.

(56) References Cited

U.S. PATENT DOCUMENTS

| | | | |
|---|---|---|---|
| 2009/0205740 | A1 | 8/2009 | Quigley |
| 2015/0013821 | A1 | 1/2015 | Ueda |
| 2015/0337492 | A1 | 11/2015 | Uymur et al. |

FOREIGN PATENT DOCUMENTS

| | | | |
|---|---|---|---|
| EP | 1659212 | A2 | 5/2006 |
| JP | 2001-098483 | A | 4/2001 |
| JP | 2003-342889 | A | 12/2003 |
| JP | 2006-057216 | A | 3/2006 |
| JP | 2006-144145 | A | 6/2006 |
| JP | 2006-152462 | A | 6/2006 |
| JP | 2015-017340 | A | 1/2015 |
| JP | 2016-503843 | A | 2/2016 |
| JP | 2017-128835 | A | 7/2017 |
| WO | 2017/126234 | A1 | 7/2017 |

OTHER PUBLICATIONS

Extended Search Report issued in European Application No. 19776203.2, dated Jul. 26, 2021.
International Search Report issued in Application No. PCT/JP2019/010206, dated May 7, 2019.
Office Action issued in Chinese Application No. 201980023501.2, dated Apr. 26, 2022.
Office Action issued in Japanese Application No. 2018-067046, dated Jun. 2, 2022.

INDUSTRIAL TWO-LAYER FABRIC

TECHNICAL FIELD OF THE INVENTION

The present invention relates to an industrial two-layered fabric including binding warps which is capable of improving an adhesive property between a fabric on a front surface side and a fabric on a back surface side and a supporting force of a weft, while at the same time, of decreasing hydration marks generated on a paper to be produced.

BACKGROUND ART

Fabrics obtained by weaving warps and wefts have conventionally been used widely as an industrial fabric. They are, for example, used in various fields including papermaking fabrics, conveyor belts and filter cloths and are required to have fabric properties suited for the intended use or using environments. Of such fabrics, a papermaking fabric used in a papermaking step for removing water from raw materials by making use of the network of the fabric must satisfy a severe demand.

For example, there is a demand for the development of fabrics which do not transfer a wire mark of the fabric and therefore have excellent surface property, the ones which have enough hydration property for sufficiently and uniformly hydrating excess water contained in the material and enough rigidity or wear resistance to be usable desirably even under severe environments, or the ones which are capable of maintaining conditions necessary for making good paper for a prolonged period of time.

In addition, fiber supporting property, improvement in a paper making yield, dimensional stability and running stability are demanded.

In recent years, owing to the speed-up of a paper making machine, requirements for papermaking fabrics become severe further.

Since most of the demands for industrial fabrics and solutions thereof can be understood if papermaking fabrics on which the most severe demand is imposed among industrial fabrics is described, the papermaking fabric will hereinafter be described as a representative example.

In the industrial fabric in which the fabric on the front surface side and the fabric on the back surface side are bound by the binding warps, it is widely known that the portion where the fabric on the front surface side and the fabric on the back surface side contact become worn while they are run by the paper making machine. In particular, the generation of the inner abrasion increases due to the speed up of the paper making machine in recent years. In a case where the inner abrasion is caused, the degree of the ventilation of the net is deteriorated due to the fact that the surface of the yarns inside the fabric becomes fluffy, so that the hydration speed decreases.

In order to prevent such an inner abrasion, a method of increasing an adhesive force between the fabric on the front surface side and the fabric on the back surface side is known. For instance, the method of increasing the number of the binding warps is disclosed as an example of such a method of increasing an adhesive force between the fabric on the front surface side and the fabric on the back surface side (refer to Patent publication 1).

For instance, the adhesive force between the fabric on the front surface side and the fabric on the back surface side increases by increasing the number of the binding warps, since the number of the yarns binding the fabric on the front surface side and the fabric on the back surface side increases by increasing the binding ratio in the complete structure.

However, the hydration mark tends to generate in the fabric on the front surface side by the increasing the binding ratio, according to the above method. More specifically, in the industrial fabric including the binding warps, it is general that a knuckle is not formed at the point where the knuckle is formed on the fabric on the front surface by the warps on the front surface side, but that the warps on the back surface side forms a knuckle on the fabric on the front surface side (refer to Patent publication 2).

In a point where a knuckle on the front surface side is complemented by the warps on the back surface side, since the warps on the front surface side is caused to be collapsed, the density of the warps is substantially doubled. At the portion where the density of the warps is increased, the hydration is obstructed. In addition, in a case where the number of the binding warps and the ratio of the binding are increased in such a structure of the fabric, the hydration marks are formed on the surface of the pater to be produced, since the points of the obstruction of the hydration are evenly arranged, so that a line on which the obstruction of the hydration occurs is formed.

In order not to make the hydration obstruction points by the binding warps densely crowded, a method of lengthening the longitudinal direction of the complete structure by increasing the number of the warps in the complete structure is known. The density of the hydration obstruction points can be lowered by such a structure. However, if such a structure is applied to the normal fabric, one single binding yarn consecutively forms a plurality of knuckles on the fabric on the front surface. In addition, in case of the fabric in which one single binding yarn consecutively forms a plurality of knuckles on the fabric on the front surface, it is known that the shape of the fabric is a mountain shape with the central portion of each of the plurality of knuckles being an apex. For instance, the warp passes above the weft to form a knuckle on the fabric on the front surface side.

Such a fabric structure deforms into a mountain shape whose apex is the weft located to be center, due to the stress generated on the yarns. In addition, the warps can form a long knuckle on the plurality of wefts. Such a fabric structure can also deform into a mountain shape whose apex is the weft located to be center, due to the stress generated on the yarns.

The portions protruding like a mountain can deteriorate the surface smoothness of the fabric in addition to the hydration marks. In order to solve such a technical problem, the fabric is disclosed in the Patent Publication 3. Further, a structure in which two sets of binding wefts are arranged to be adjacent to each other can be devised, based on the fabric disclosed in the Patent Publication 3.

In the above fabric, in order to maintain the surface smoothness, it is necessary for the diameter of the binding warp to conform to that of the warp on the front surface side. In the above fabric, the binding warp is arranged to be adjacent to one or a plurality of upper and lower warps, and is woven so as to complement the fabric structure on the front and back surface sides, with making two binding warps to form a pair to repeatedly cross. Due to the above, the hydration path is blocked by the cross sections which are repeatedly formed in the longitudinal direction with a constant cycle, so that the hydration speed differs from that of other portions. The hydration marks can be caused on the paper due to the above action.

In addition, in the industrial two-layered fabric including the binding warps, the wefts on the back surface side with a large diameter is normally adopted in order to deal with the abrasion. This leads to adopt the warp on the back surface with a large diameter. Such being the case, in a case where two or more yarns with large diameters are arranged, a wide space portion occupied by the binding warps located on a points where adjacent binding warps do not cross on the back surface side, and a narrow space portion occupied by the warps located on points where upper and lower warps with different diameters are generated, so that the hydration speeds differ, which causes the generation of the hydration marks to be accelerated.

That is to say, since the fabric in which the fabric on the front surface side and the fabric on the back surface side are bound by the binding warps maintains the surface smoothness, it was necessary to make the surface fine and make the shape of the knuckles formed on the front surface uniform by adopting yarns with diameters small than that on the back surface side, as the warps on the front surface side and the wefts. In addition, it was necessary to bind the front surface side and the back surface side by forming the knuckles on both of the front and back surfaces by means of the binding warps, and, it was necessary to make the diameter of the binding warps conform to that of the warps on the front surface side in order to maintain the surface smoothness.

In addition, it is necessary to make the diameter of the weft on the back surface side large in order to improve the rigidity and the abrasion resistance of the fabric and restrict its extension in the longitudinal direction. Further, it was necessary to make the diameter of the warp on the back surface side large in order to weave the warp on the back surface side with the weft on the back surface side with a large diameter. Still further, with respect to the arrangement of the yarns, it is normal to make the warp on the front surface side and the warp on the back surface side a pair to arrange a couple of the binding warps on the front surface side and the binding warp on the back surface side therebetween, and to set the ratio of the warps on the back surface side to the binding warps on the back surface side to be 1/1. And as a result, the space occupied by the binding portion and the space occupied by the warps on the front and back surface sides differ, so that the cycle in which the biding warps cross becomes long, whereby the generation of the hydration marks can be accelerated.

Patent Publication 1: Japanese Patent Laid-open Publication 2001-98483

Patent Publication 2: Japanese Patent Laid-open Publication 2003-342889

Patent Publication 3: Japanese Patent Laid-open Publication 2006-57216

DISCLOSURE OF THE INVENTION

Technical Problems to be Solved by Present Invention

The object of the present invention is to provide an industrial two-layered fabric including binding wefts which is capable of improving a high adhesivity of the fabric on the front and back surface sides and the supportability of the warps, without deteriorating the surface smoothness, the abrasion resistance on the back surface side, the extension resistance in the longitudinal direction and the hydration property, which have been conventionally desired.

The object of the present invention is to provide an industrial two-layered fabric including binding wefts which is capable of decreasing the abrasion of the binding yarns by changing the arrangement of the warps and the binding warps, while at the same time, of decreasing the generation of the hydration marks by means of an even hydration.

Means to Solve Technical Problems

The industrial two-layered fabric of the present invention includes following technical features in order to solve the above technical problems.

(1) In the industrial two-layered fabric with a complete structure of the present invention includes a fabric on a front surface side consisting of a weft on the front surface side and a warp on the front surface side and a fabric on a back surface side consisting of a weft on the back surface side and a warp on the back surface side, the fabric on a front surface side and the fabric on a back surface side are bound by a binding warp, the industrial two-layered fabric includes a first pair of warps consisting of a warp on the front surface side and a warp on the back surface side, and a second pair of warps consisting of a binding warp on the front surface side and a binding warp on the back surface side which functions to bind the fabric on the front surface side and the fabric on the back surface side, the one of the binding warp constituting the second pair of the wefts consecutively forms a plurality of knuckles on the fabric on the front surface side, while the other of the binding warps does not emerge on the front surface side at a portion where a plurality of knuckles are formed, and the other binding warp consecutively forms a plurality of knuckles on the fabric on the front surface side, while the one binding warp does not emerge on the front surface side, whereby a complementary structure is formed, the diameter of the warp on the front surface side is set to be substantially the same as that of the binding warp, and the diameter of the warp on the back surface side is set to be larger than that of the binding warp on the front surface side.

In the present invention, the rigidity and the abrasion resistance of the fabric can be improved by adopting such a structure. In short, in the industrial two-layered fabric of the present invention, since the diameter of the warp on the back surface side is be larger than that of the warp on the front surface side, the diameter of the weft on the back surface side woven with the warp with a large diameter can be also thickened.

(2) In the industrial two-layered fabric of the present invention, the second pair of warps may be arranged between said first pair of warps.

In the present invention, the abrasion resistance of the binding yarn can be improved by the arrangement of the warp and the binding warp being changed.

(3) In the industrial two-layered fabric of the present invention, the ratio of the warps on the front surface side to the warps on the back surface side may be 1:1.

(4) In the industrial two-layered fabric of the present invention, two sets of the second pair of the warps may be arranged to be adjacent to each other, and the first pair of warps may be arranged on each side of the second pair of the warps, and such an arrangement is repeated.

In such a structure, two sets of the second pair of the warps may be arranged to be adjacent to each other, which means that, totally, four binding warps are arranged. The first pair of warps may be arranged on each side of the second pair of the warps. More specifically, four sets of the pair of warps are repeatedly arranged.

In the present invention, the technical problem that the generation of the hydration mark is accelerated is solved. More specifically, since two sets of the second pair of the warps including binding portion are arranged to be adjacent to the first pair of warps, and such a pattern is repeated, one or more binding yarns with a small dimeter never fails to be arranged to be adjacent to the one weft on the back surface side, an uniform hydration is attained by the block of the hydration path being restricted, so that the generation of the hydration marks can be decreased.

(5) In the industrial two-layered fabric of the present invention, the cross sectional shaper of the weft on the front surface side, the warp on the front surface side, the weft on the back surface side, the warp on the back surface side, or the binding warp may be circle, square or short form such as stellar form, or elliptical.

Effect of the Invention

By adopting industrial two-layered fabric of the present invention, the industrial two-layered fabric including binding wefts which is capable of improving a high adhesivity of the fabric on the front and back surface sides and the supportability of the wefts, without deteriorating the surface smoothness, the abrasion resistance on the back surface side, the extension resistance in the longitudinal direction and the hydration property can be provided.

By adopting industrial two-layered fabric of the present invention, the industrial two-layered fabric including binding warps which is capable of decreasing the abrasion of the binding yarns by changing the arrangement of the warps and the binding warps, while at the same time, of decreasing the generation of the hydration marks by means of an even hydration can be provided.

DETAILED DESCRIPTION OF THE INVENTION

Figure 1:
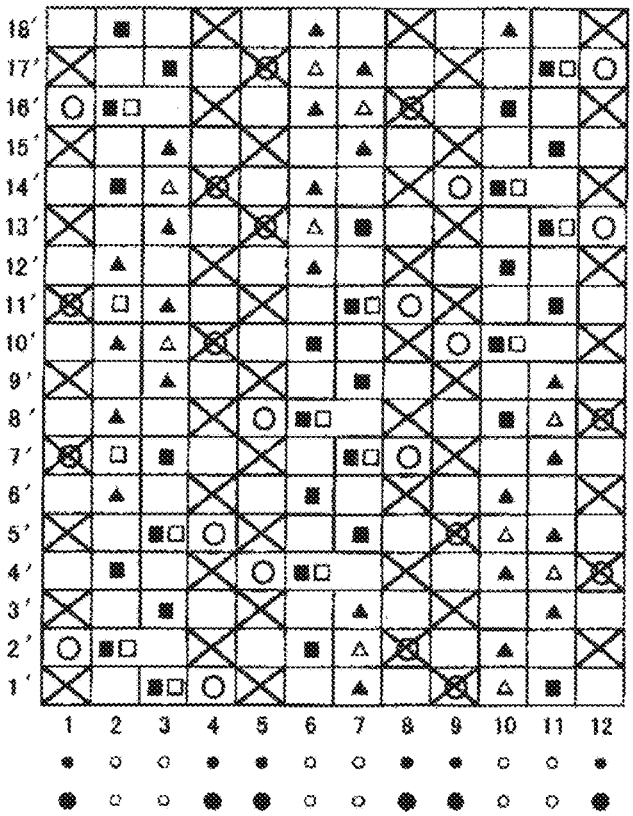
FIG. 1 is a design view showing a complete structure of the first embodiment according to the industrial two-layered fabric of the present invention.

Now, the structure and the effect of the two-layered fabric of the present invention will be described below. Embodiments of the two-layered fabric of the present invention will be described thereafter with reference to the drawings.

In the industrial two-layered fabric with a complete structure of the present invention, a fabric on a front surface side consisting of a weft on the front surface side and a warp on the front surface side and a fabric on a back surface side consisting of a weft on the back surface side and a warp on the back surface side are bound by a binding warp. In the industrial two-layered fabric includes a first pair of warps consisting of a warp on the front surface side and a warp on the back surface side, and a second pair of warps which two binding warps are arranged to be adjacent to each other so as to function to bind the fabric on the front surface side and the fabric on the back surface side.

The one of the binding warp constituting the second pair of the warps consecutively forms a plurality of knuckles on the fabric on the front surface side, while the other of the binding warps does not emerge on the front surface side at a portion where a plurality of knuckles are formed, and the other binding warp consecutively forms a plurality of knuckles on the fabric on the front surface side, while the one binding warp does not emerge on the front surface side, whereby a complementary structure is formed. That is to say, the second pair of warps forms one structure on the fabric on the front surface side by the complementing of two binding warps. Further, the binding warps can be defined to be the binding warps which functions as the binding yarn with mainly being woven with the front surface side, or the binding warps which functions as the binding yarn with mainly being woven with the back surface side.

In addition, the diameter of the warp on the front surface side is set to be substantially the same as that of the binding warp, and the diameter of the warp on the back surface side is set to be larger than that of the binding warp on the front surface side. The complete structure of the present invention in the industrial two-layered fabric includes eight or more shafts.

In the complete structure of the present invention in the industrial two-layered fabric, the first pair of warps and the second pair of warps are alternatively arranged. Still further, two sets of the second pair of the warps may be arranged to be adjacent to each other, and the first pair of warps may be arranged on each side of the second pair of the warps, and such an arrangement is repeated.

In the complete structure of the present invention in the industrial two-layered fabric, the ratio of the warps on the front surface side to the wefts on the back surface side may be 1:1.

No particular limitation is imposed on a yarn to be used in the present invention and it can be selected freely depending on the properties which an industrial fabric is desired to have. Examples of it include, in addition to monofilaments, multifilaments, spun yarns, finished yarns subjected to crimping or bulking such as so-called textured yarn, bulky yarn and stretch yarn, and yarns obtained by intertwining them. As the cross-section of the yarn, not only circular form but also square or short form such as stellar form, or elliptical or hollow form can be used. The material of the yarn can be selected freely and usable examples of it include polyester, polyamide, polyphenylene sulfide, polyvinylidene fluoride, polypropylene, aramid, polyether ketone, polyethylene naphthalate, polytetrafluoroethylene, cotton, wool and metal. Of course, yarns obtained using copolymers or incorporating or mixing the above-described material with a substance selected depending on the intended purpose may be used.

As the upper surface side warps, lower surface side warps, and upper surface side wefts, use of a polyester monofilament having rigidity and excellent dimensional stability is usually preferred. When lower surface side wefts which need wear resistance are obtained by interweaving of polyester monofilaments and polyamide monofilaments while arranging them alternately, they are able to have wear resistance without losing rigidity.

It is also possible to place a plurality of yarns with the same design at a position where one yarn is normally placed from the standpoint of design. Design of a plurality of yarns having a thin diameter brings about improvement in surface property and thinning of the fabric.

Now, the embodiments of the present invention will be described below. Each of the embodiments described below is an example of the present invention which does not limit the scope of the present invention.

The embodiments of the present invention will be described below with reference to the drawings. Each of FIGS. 1 to 8 is a design view showing a complete structure of embodiments 1 to 4 of the present invention. Here, the design view corresponds to the complete structure of the fabric defining the minimum unit to be repeated of the fabric structure. The final product is completed by combining any number of such complete structures in the longitudinal direction and the direction perpendicular to the longitudinal direction.

In each of the design views, the warp is indicated by a reference number such as 1, 2, 3 . . . . In the embodiments, a first pair of warps consisting of a warp on the front surface side and a warp on the back surface side, and a second pair of warps in which two sets of two biding warps are arranged to be adjacent to each other are shown. The weft is indicated by a reference number such as 1',2', 3' . . . .

In addition, in each of the design views, a symbol "×" indicates that the warp on the front surface side is arranged above the weft on the front surface side. A symbol "○" indicates that the warp on the back surface side is arranged below the weft on the back surface side. A symbol "□" indicates that the binding warp on the back surface side is arranged below the weft on the back surface side. A symbol "▲" indicates that the binding warp on the back surface side is arranged above the weft on the front surface side. A symbol "Δ" indicates that the binding warp on the front surface side is arranged below the weft on the back surface side. A symbol "■" indicates that the binding warp on the front surface side is arranged below the weft on the front surface side. The warps and the wefts on the upper surface side are arranged to be overlapped with the warps and the wefts on the lower surface side, respectively. In this connection, in the design view, the warps and the wefts on the upper surface side are depicted to be precisely arranged over the warps and the wefts on the upper surface side, because of the clarity of the drawing. In the real fabric, it does not matter if they are arranged to be offset.

DETAILED DESCRIPTION OF THE INVENTION

Embodiment 1

FIG. 1 is a design view showing a complete structure of the first embodiment according to the industrial two-layered fabric of the present invention. A complete structure of the industrial two-layered fabric according to the embodiment 1 includes a first pair of warps consisting of warps (1,4,5,8,9,12) on the front surface side and warps (1,4,5,8,9,12) on the back surface side which does not include the binding warps and a second pair of warps consisting of binding warps (2,3,6,7,10,11) on the front surface side and binding warps (2,3,6,7,10,11) on the back surface side which includes a binding functions.

Figure 2:
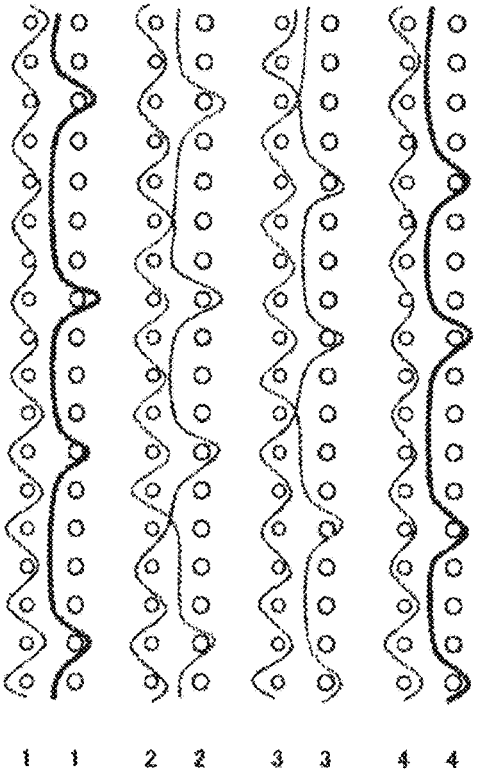
FIG. 2 is a view showing a cross section in the warp direction of the pairs 1 to 4 of the warps of the first embodiment illustrated in FIG. 1.
Figure 3:
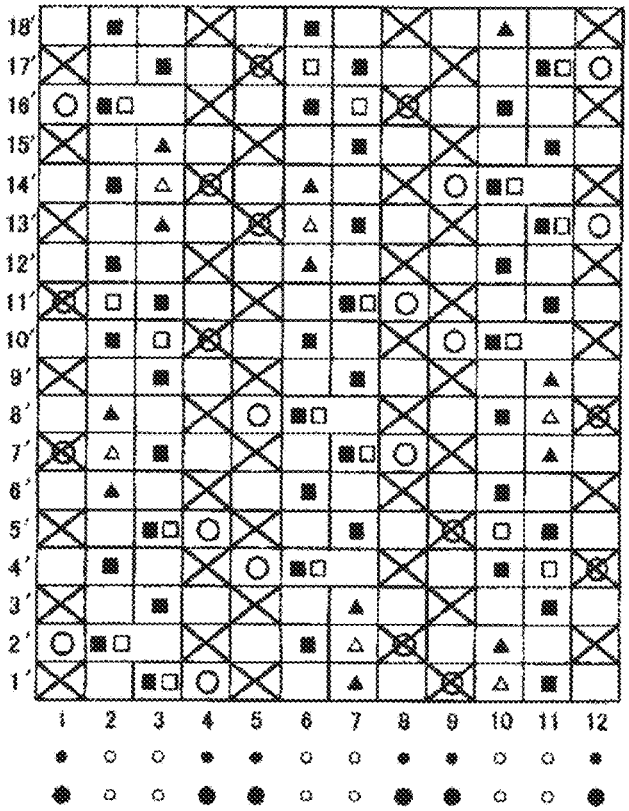
FIG. 3 is a design view showing a complete structure of the second embodiment according to the industrial two-layered fabric of present invention.

The first pair 1 of warps are alternately woven with the wefts on the front surface side in such a way that the warp on the front surface side forms a plain weaving on the fabric on the front surface side, while the warps on the back surface side are woven with the wefts on the back surface side, as shown in the warps 1 on the back surface side in FIG. 2, and as a result, a ¼-⅓ structure is formed on the fabric on the back surface side.

In addition, a second pair of warps never fails to be arranged at a position adjacent to each of the first pair of warps. For instance, two sets 2,3 of a second pair of warps are arranged at a position adjacent to each of the first pair 1 of warps. More specifically, as shown in FIG. 2, the binding warp 2 among the second pair 2,3 of warps passes below the weft 1' on the front surface side, above the wefts 2',4' on the front surface side, below the wefts 7',11' on the back surface side, and above the wefts 14',16',18' on the front surface side to form a knuckle, while the binding warp 2 on the back surfaces side among the second pair 2,3 of warps passes above the weft 1' on the back surface side, below the weft 2' on the back surface side, above the wefts 6',8', 10',12' on the front surface side, and below the weft 16' on the back surface side to bind the fabric on the front surface side with the fabric on the back surface side.

In addition, the second pair 2,3 of warps are arranged to be adjacent to the first pair 4 of warps. The warp 4 in the first pair of warps forms a plain weaving on the fabric on the front surface side. The binding warp 3 on the front surface side among the second pair 2,3 of warps passes above the wefts 1', 3', 5', 7' on the front surface side, below the wefts 10',14' on the back surface side, and above the weft 17' on the front surface side to form a knuckle, while the binding warp 3 on the back surfaces side among the second pair 2,3 of warps passes below the wefts 1',5' on the back surface side, and above the wefts 9', 11', 13', 15' on the back surface side to bind the fabric on the front surface side with the fabric on the back surface side.

Further, the second pair 6,7 of warps are arranged to be adjacent to the first pair 5 of warps. The second pair 6,7 of warps are also arranged to be adjacent to the first pair 8 of warps. The second pair 10,11 of warps are arranged to be adjacent to the first pair 9 of warps, while the second pair 10,11 of warps are also arranged to be adjacent to the first pair 12 of warps.

By adopting such a structure, since the binding warps with small diameters never fails to be arranged to be adjacent to the warps on the back surface side with large dimeters, the uniform hydration speed can be secured, so that the generation of the hydration marks can be decreased. In addition, the abrasion resistance on the back surface side and the extension resistance in the longitudinal direction can be improved, so that the adhesive property between the fabric on the front surface side and the fabric on the back surface side can be enhanced.

Embodiment 2

FIG. 2 is a design view showing a complete structure of the second embodiment according to the industrial two-layered fabric of the present invention. A complete structure of the industrial two-layered fabric according to the embodiment 2 includes a first pair of warps consisting of warps (1,4,5,8,9,12) on the front surface side and warps (1,4,5,8,9,12) on the back surface side which does not include the binding warps and a second pair of warps consisting of binding warps (2,3,6,7,10,11) on the front surface side and binding warps (2,3,6,7,10,11) on the back surface side which includes binding functions.

Figure 4:
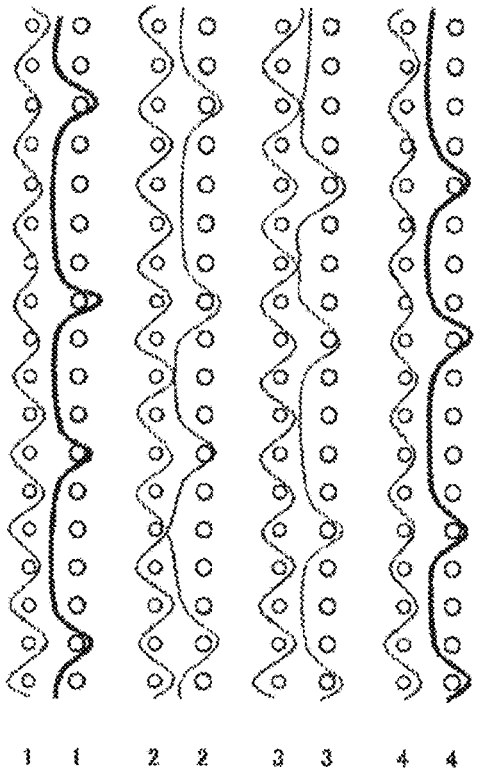
FIG. 4 is a view showing a cross section in the warp direction of the pairs 1 to 4 of the warps of the second embodiment illustrated in FIG. 3.

The first pair 1 of warps are alternately woven with the wefts on the front surface side in such a way that the warp on the front surface side forms a plain weaving on the fabric on the front surface side, while the warps on the back surface side are woven with the wefts on the back surface side, as shown in the warps 1 on the back surface side in FIG. 4, and as a result, a ¼-⅓ structure is formed on the fabric on the back surface side.

In addition, a second pair of warps never fails to be arranged at a position adjacent to each of the first pair of warps. For instance, two sets 2,3 of a second pair of warps are arranged at a position adjacent to each of the first pair 1 of warps. More specifically, as shown in FIG. 4, the binding warp 2 among the second pair 2,3 of warps passes below the weft 1' on the front surface side, above the weft 2',4' on the front surface side, below the weft 7' on the back surface side, and above the weft 10',12',14', 16',18' on the front surface side to form a knuckle, while the binding warp 2 on the back surfaces side among the second pair 2,3 of warps passes above the weft 1' on the back surface side, below the weft 2' on the back surface side, above the wefts 6',8' on the front surface side, and below the wefts 11',16' on the back surface side to bind the fabric on the front surface side with the fabric on the back surface side.

In addition, the second pair 2,3 of warps are arranged to be adjacent to the first pair 4 of warps. The warp 4 in the first pair of warps forms a plain weaving on the fabric on the front surface side. The binding warp 3 on the front surface side among the second pair 2,3 of warps passes above the wefts 1', 3', 5', 7', 9', 11' on the front surface side, below the weft 14' on the back surface side, and above the weft 17' on the front surface side to form a knuckle, while the binding warp 3 on the back surfaces side among the second pair 2,3 of warps passes below the wefts 1',5',10' on the back surface side, and above the wefts 13', 15' on the back surface side to bind the fabric on the front surface side with the fabric on the back surface side.

Further, the second pair 6,7 of warps are arranged to be adjacent to the first pair 5 of warps. The second pair 6,7 of warps are also arranged to be adjacent to the first pair 8 of warps. The second pair 10,11 of warps are arranged to be adjacent to the first pair 9 of warps, while the second pair 10,11 of warps are also arranged to be adjacent to the first pair 12 of warps.

By adopting such a structure, since the binding warps with small diameters never fails to be arranged to be adjacent to the warps on the back surface side with large dimeters, the uniform hydration speed can be secured, so that the generation of the hydration marks can be decreased. In addition, the abrasion resistance on the back surface side and the extension resistance in the longitudinal direction can be improved, so that the adhesive property between the fabric on the front surface side and the fabric on the back surface side can be enhanced.

Embodiment 3

Figure 5:
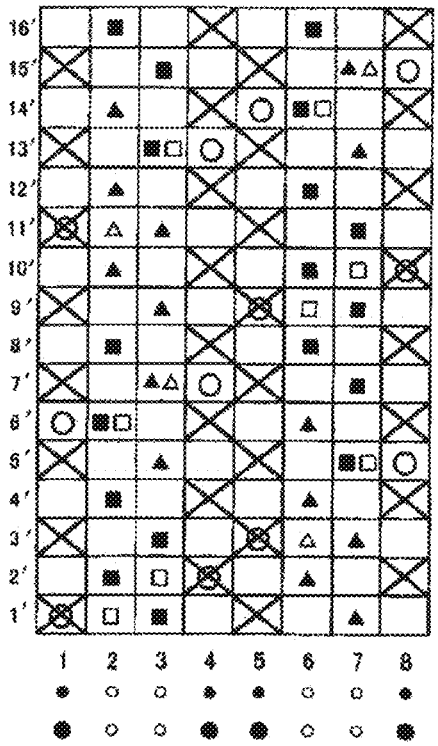
FIG. 5 is a design view showing a complete structure of the third embodiment according to the industrial two-layered fabric of present invention.

FIG. 5 is a design view showing a complete structure of the third embodiment according to the industrial two-layered fabric of the present invention. A complete structure of the industrial two-layered fabric according to the embodiment 3 includes a first pair of warps consisting of warps (1,4,5,8) on the front surface side and warps (1,4,5,8) on the back surface side which does not include the binding warps and a second pair of warps consisting of binding warps (2,3,6,7) on the front surface side and binding warps (2,3,6,7) on the back surface side which includes a binding functions.

Figure 6:
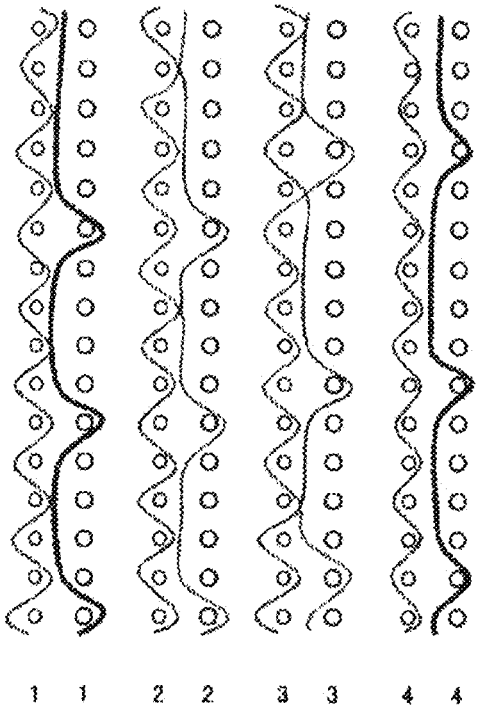
FIG. 6 is a view showing a cross section in the warp direction of the pairs 1 to 4 of the warps of the third embodiment illustrated in FIG. 5.
Figure 7:
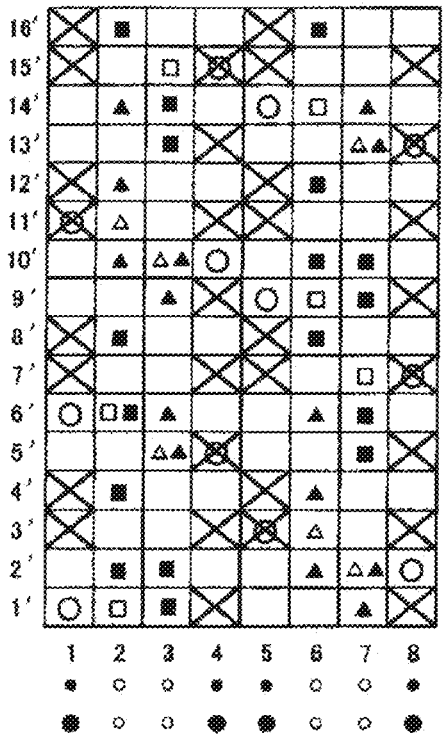
FIG. 7 is a design view showing a complete structure of the fourth embodiment according to the industrial two-layered fabric of present invention.

The first pair 1 of warps are alternately woven with the wefts on the front surface side in such a way that the warp on the front surface side forms a plain weaving on the fabric on the front surface side, while the warps on the back surface side are woven with the wefts on the back surface side, as shown in the warps 1 on the back surface side in FIG. 6, and as a result, a ¼-¼-⅕ structure is formed on the fabric on the back surface side.

In addition, a second pair of warps never fails to be arranged at a position adjacent to each of the first pair of warps. For instance, two sets (2,3) of a second pair of warps are arranged at a position adjacent to each of the first pair 1 of warps. More specifically, as shown in FIG. 5, the binding warp 2 among the second pair 2,3 of warps passes above the wefts 2',4',6',8' on the front surface side, below the weft 11' on the back surface side, and above the weft 16' on the front surface side, while the binding warp 2 on the back surfaces side among the second pair 2,3 of warps passes below the wefts 1', 6' on the back surface side, and above the wefts 10',12',14' on the front surface side to bind the fabric on the front surface side with the fabric on the back surface side.

In addition, the second pair 2,3 of warps are arranged to be adjacent to the first pair 4 of warps. The binding warp 3 on the front surface side among the second pair 2,3 of warps passes above the wefts 1', 3' on the front surface side, below the weft 7' on the back surface side, and above the wefts 13', 15' on the front surface side, while the binding warp 3 on the back surfaces side among the second pair 2,3 of warps passes below the weft 2' on the back surface side, above the wefts 5', 7', 9', 11' on the back surface side, and below the weft 13' on the back surface side to bind the fabric on the front surface side with the fabric on the back surface side.

Further, the second pair 6,7 of warps are arranged to be adjacent to the first pair 5 of warps. The second pair 6,7 of warps are also arranged to be adjacent to the first pair 8 of warps.

By adopting such a structure, since the binding warps with small diameters never fails to be arranged to be adjacent to the warps on the back surface side with large dimeters, the uniform hydration speed can be secured, so that the generation of the hydration marks can be decreased. In addition, the abrasion resistance on the back surface side and the extension resistance in the longitudinal direction can be improved, so that the adhesive property between the fabric on the front surface side and the fabric on the back surface side can be enhanced.

Embodiment 4

FIG. 1 is a design view showing a complete structure of the first embodiment according to the industrial two-layered fabric of the present invention. A complete structure of the industrial two-layered fabric according to the embodiment 1 includes a first pair of warps consisting of warps (1,4,5,8, 9,12) on the front surface side and warps (1,4,5,8,9,12) on the back surface side which does not include the binding warps and a second pair of warps consisting of binding warps (2,3,6,7,10,11) on the front surface side and binding warps (2,3,6,7,10,11) on the back surface side which includes a binding functions.

Figure 8:
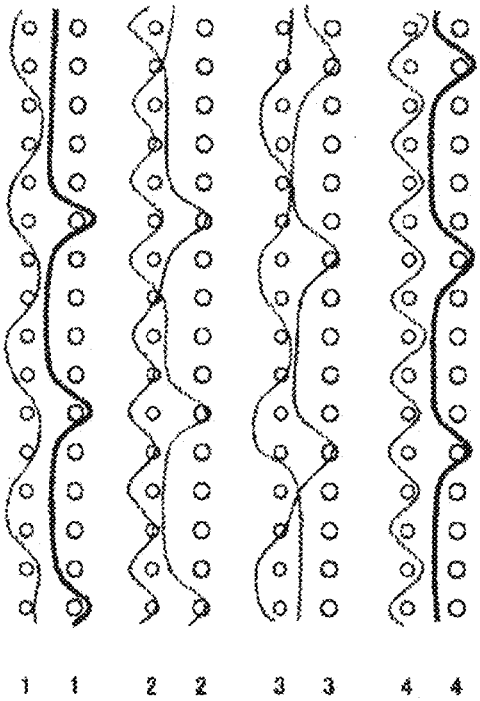
FIG. 8 is a view showing a cross section in the warp direction of the pairs 1 to 4 of the warps of the fourth embodiment illustrated in FIG. 7.

The first pair 1 of the warps are woven with the wefts on the front surface side ins such a way that the warps on the front surface side form a 2/2 structure on the fabric on the front surface side, while the warps on the back surface side are woven with the wefts on the back surface side, as shown in FIG. 8, to form a ¼-¼-⅕ structure. The first pair 5 of the warps also includes the same structure. In addition, the first pair 4 of the warps are alternately woven with the wefts on the front surface side in such a way that the warp on the front surface side forms a plain weaving on the fabric on the front surface side, while the warps on the back surface side are woven with the wefts on the back surface side, as shown in the warps 4 on the back surface side in FIG. 8, and as a result, a ¼-¼-⅕ structure is formed on the fabric on the back surface side. The first pair 8 of the warps also includes the same structure.

In addition, a second pair of warps never fails to be arranged at a position adjacent to each of the first pair of warps. For instance, two sets (2,3) of a second pair of warps are arranged at a position adjacent to each of the first pair 1 of warps. More specifically, as shown in FIG. 8, the binding warp 2 among the second pair 2,3 of warps passes above the wefts 2',4',6',8' on the front surface side, below the weft 11' on the back surface side, and above the weft 16' on the front surface side, while the binding warp 2 on the back surfaces side among the second pair 2,3 of warps passes below the wefts 1', 6' on the back surface side, and above the wefts 10',12',14' on the front surface side, to bind the fabric on the front surface side with the fabric on the back surface side.

In addition, the second pair 2,3 of warps are arranged to be adjacent to the first pair 4 of warps. The binding warp 3 on the front surface side among the second pair 2,3 of warps passes above the wefts 1', 2' on the front surface side, below the wefts 5',10' on the back surface side, and above the wefts 13',14' on the front surface side, while the binding warp 3 on the back surfaces side among the second pair 2,3 of warps passes above the wefts 5',6' on the back surface side, below the wefts 7', 8' on the back surface side, the wefts 9',10' on the front surface side, and below the weft 15',6' on the back surface side to bind the fabric on the front surface side with the fabric on the back surface side.

Further, the second pair 6,7 of warps are arranged to be adjacent to the first pair 5 of warps. The second pair 6,7 of warps are also arranged to be adjacent to the first pair 8 of warps.

By adopting such a structure, since the binding warps with small diameters never fails to be arranged to be adjacent to the warps on the back surface side with large dimeters, the uniform hydration speed can be secured, so that the generation of the hydration marks can be decreased. In addition, the abrasion resistance on the back surface side and the extension resistance in the longitudinal direction can be improved, so that the adhesive property between the fabric on the front surface side and the fabric on the back surface side can be enhanced.

EXPLANATION OF SYMBOLS

1~12: warp

1'~18': weft

What is claimed is:

1. An industrial two-layered fabric comprising:

a fabric on a front surface side comprising a weft on the front surface side and a warp on the front surface side; and a fabric on a back surface side comprising a weft on the back surface side and a warp on the back surface side;

the fabric on the front surface side and the fabric on the back surface side are bound by a binding warp;

the fabric on the front surface side consists, in a minimum unit, of 18 wefts on the front surface side;

the industrial two-layered fabric includes:

a first pair of warps consisting of a warp on the front surface side that weaves only a weft on the front surface side and a warp on the back surface side that weaves only the back surface side; and a second pair of warps consisting of a binding warp on the front surface side and a binding warp on the back surface side, which bind the fabric on the front surface side and the fabric on the back surface side;

wherein, in the minimum unit:

the binding warp on the front surface side consists of five knuckles consecutively formed on the fabric on the front surface side, while the binding warp on the back surface side does not emerge on the front surface side at a portion where the five knuckles are formed by the binding warp on the front surface side; and the binding warp on the back surface side consists of four knuckles consecutively formed on the fabric on the front surface side adjacent to the five knuckles, while the binding warp on the front surface side does not emerge on the front surface side.

2. The industrial two-layered fabric according to claim 1, the second pair of warps is arranged between said first pairs of warps.

3. The industrial two-layered fabric according to claim 1, a ratio of the warps on the front surface side to the warps on the back surface side is 1:1.

4. The industrial two-layered fabric according to claim 2, two of the second pairs of the warps are arranged to be adjacent to each other, and the first pair of warps is arranged on each side of the two of the second pairs of the warps, and such an arrangement is repeated.

5. The industrial two-layered fabric according to claim 1, a cross sectional shape of the warp on the front surface side, the weft on the front surface side, the weft on the back surface side, the warp on the back surface side, or the binding warp is one selected from the group consisting of a circle, a star, a quadrangle and an ellipse.

6. The industrial two-layered fabric according to claim 1, wherein:

a diameter of the warp on the front surface side is set to be substantially the same as a diameter of the binding warp, and a diameter of the warp on the back surface side is set to be larger than the diameter of the binding warp on the front surface side.

7. The industrial two-layered fabric according to claim 1, wherein:

the warp on the back surface side of said first pair of warps forms four knuckles on the back side.

* * * * *